US006189509B1

(12) United States Patent
Froment

(10) Patent No.: US 6,189,509 B1
(45) Date of Patent: Feb. 20, 2001

(54) DEVICE FOR INJECTING FUEL INTO A DIESEL ENGINE

(75) Inventor: Jean-Louis Froment, Lyons (FR)

(73) Assignee: Cummins Wartsila S.A., Mulhouse (FR)

( * ) Notice: Under 35 U.S.C. 154(b), the term of this patent shall be extended for 0 days.

(21) Appl. No.: 09/462,836

(22) PCT Filed: Jul. 13, 1998

(86) PCT No.: PCT/FR98/01524

§ 371 Date: Jan. 13, 2000

§ 102(e) Date: Jan. 13, 2000

(87) PCT Pub. No.: WO99/04160

PCT Pub. Date: Jan. 28, 1999

(30) Foreign Application Priority Data

Jul. 16, 1997 (FR) ..... 97 09196
Mar. 6, 1998 (FR) ..... 98 02938

(51) Int. Cl.[7] ..... F02M 37/04
(52) U.S. Cl. ..... 123/467; 123/299
(58) Field of Search ..... 123/467, 299, 123/300, 500, 501

(56) References Cited

U.S. PATENT DOCUMENTS

| | | | | |
|---|---|---|---|---|
| 4,249,497 | | 2/1981 | Eheim et al. . | |
| 4,440,132 | * | 4/1984 | Terada et al. | 123/446 |
| 4,545,352 | | 10/1985 | Jourde et al. . | |
| 4,741,478 | | 5/1988 | Teerman et al. . | |
| 5,626,119 | | 5/1997 | Timms . | |
| 5,647,316 | * | 7/1997 | Hellen et al. | 123/299 |
| 5,664,545 | * | 9/1997 | Kato et al. | 123/496 |
| 5,740,775 | * | 4/1998 | Suzuki et al. | 123/299 |
| 5,771,865 | * | 6/1998 | Ishida | 123/467 |

FOREIGN PATENT DOCUMENTS

| | | |
|---|---|---|
| 42 36 882 | 4/1994 | (DE) . |
| 42 40 517 | 6/1994 | (DE) . |
| 44 06 901 | 9/1995 | (DE) . |
| 2 016 477 | 5/1970 | (FR) . |
| 2 752 268 | 2/1998 | (FR) . |

* cited by examiner

*Primary Examiner*—Carl S. Miller
(74) *Attorney, Agent, or Firm*—Davis and Bujold

(57) ABSTRACT

The invention concerns a device for injecting fuel into a diesel engine using a pulsating flow pump for improving the fuel performance of the engines by controlling the beginning and the end of the injection. It comprises a device (20) controlling the closing and opening of the nozzle needle (5) provided with a discharge circuit (21, 21') controlled by an electrovalve (25) in branched connection between the high pressure supply conduit (7) and the low pressure return conduit (8). The discharge circuit (21, 21') comprises a discharge valve (22) whereof the opening and the closing are slowed down by a calibrated orifice (23). The discharge valve (22) located upstream of a discharge orifice (27) provided on the return conduit (8) enables to deviate part of the non-injected fuel flow towards the nozzle needle (5) to exert thereon a closing pressure. Consequently, this results in a better control over the opening and closing of the nozzle needle (5). A calibrated valve (24) ensures that the pressure in the discharge circuit (21) is maintained between two injections. During the injection cycle, the supply of fuel towards the nozzle needle (5) is not impeded by the control device (20) components. The invention is applicable to diesel engines using pulsating injection pumps.

13 Claims, 7 Drawing Sheets

DEVICE FOR INJECTING FUEL INTO A DIESEL ENGINE

The present invention relates to a fuel injection device for Diesel engines equipped with pulsating injection pumps, this device comprising, per piston, at least one injector receiving a calibrated injector needle designed to inject calibrated fuel jets into the combustion chamber of said piston, a high pressure supply conduit for the fuel and a low pressure fuel return conduit.

BACKGROUND OF THE INVENTION

Specifications for developing Diesel engines are constantly changing. This technical constraint is mainly linked to the fields of environment and economy such as the emissions pollutants (nitrogen oxides, hydrocarbons, particles, etc.), the noise made by the engine or fuel consumption. The requirements in terms of optimizing the combustion environment to take into account these evolutions in specifications require a particular effort regarding the injection process. The ideal injection which would make it possible to obtain a pollution-free combustion would be achieved if:

1. the start of fuel inlet is performed at low flow rate so as to not mix too much fuel with the air from the combustion chamber during the ignition time, the injected flow constantly increases so that the combustion fully accompanies the start of expansion associated with movement of the piston in the engine's cylinder,
2. the fuel pressure is important to obtain proper pulverization and consequently good mixing of the fuel with the air,
3. the end of the injection is clear-cut to limit the insufficiently pulverized fuel inlet and reduce combustion trails as much as possible.

In practice, conventional strategies generally used are for example increasing the compression ratio, reducing the injection advance, increasing injection pressures.

These strategies aim to compress the main combustion period into a shorter period of time which is better located at the start of the pressure reduction. Despite everything, the combustion performance remains very sensitive to the details of form of the law on fuel inlet in the combustion chamber.

In standard injection devices using a pulsating pump, the injection pump, by delivering the fuel, makes the pressure increase progressively in the pump's volumes, the conduits and the injector. This progressive increase takes place before and then during the injection period. After the pump has stopped delivering, the injection ends with the effect of the depressurization of these same volumes, the injector needle being solely controlled by a basic return device comprising one or several springs.

The advantage of these injection devices relates to the injection start which, in this case, is relatively moderate and, consequently, favorable to items 1 and 2 mentioned above, unless one needs too high a cutting-in pressure for the injector.

On the other hand, the major drawback is that the injector only closes when the pressure has become much lower than the cutting-in pressure. As a result, the end of the injection is not efficient and generates combustion trails, bringing about emissions of soot and penalizing efficiency.

In so-called "Common-Rail" constant pressure injection devices, the high-pressure pump feeds all the injectors at a virtually constant and adjustable pressure to adjust the inlet rate and the pulverization of fuel. The opening and the closing of each injector are controlled by one electrovalve, which makes it possible to adjust the injection advance and the quantity injected, in accordance with certain examples of embodiment described in publications FR-A-2 016 477, U.S. Pat. No. 4,545,352, DE-C-42 36 882, DE-A-44 06 901 and U.S. Pat. No. 4,249,497.

The advantage of these injection devices is the flexibility of the potential adjustments and especially the very good end of injection by controlled closing, which is favorable to items 3 and 4 above.

Nevertheless, the major drawback lies in the fact that at the start of the injection, the injected flow very quickly reaches the maximum flow, which is detrimental to items 1 and 2 above. It is possible to neutralize the effect on the ignition deflagration (item 1) by using the pre-injection, but there is little chance of making the law of fuel inlet (item 2) progressive.

SUMMARY OF THE INVENTION

The aim of the present invention is to provide an effective solution to improve the performance of conventional injection devices using a pulsating pump in order to effectively fulfil increasingly stringent requirements and notably by providing a more moderate injection start than with conventional devices, favorable to item 1 mentioned above, with the possibility of performing a pre-injection, an injection pressure which increases during the whole injection period, favorable to item 2 above, an end of injection which is as clear-cut as with constant pressure devices, favorable to item 4 above, an adjustable injection advance.

This aim is achieved by an injection device such as the one defined in the preamble and characterized in that it comprises a device for controlling the opening and the closing of the injector needle, this device comprising a discharge circuit connecting the supply conduit and the return conduit for the fuel, this circuit being controlled by an electrovalve and comprising, upstream from the electrovalve, a relief valve provided with calibrated orifice, this valve communicating both with the said electrovalve and a discharge orifice arranged on the return conduit and being designed to ensure that both the start of the injection is progressive and that this injection closes quickly by diverting the flow of fuel not injected towards said discharge orifice which, when depressurizing the supply conduit, generates a closing pressure on the injector needle.

In one embodiment of the invention, the control device can comprise a calibrated flap arranged upstream or downstream from the electrovalve, this flap being designed to keep the injection device at a required pressure level between two injections.

Generally speaking, the discharge circuit is independent of the high-pressure fuel injection circuit during the injection cycle, the relief valve and the electrovalve being closed.

Depending on the case, the closing pressure can be applied directly on the injector needle or by means of a piston.

In one alternative embodiment, the control device can comprise a delay orifice arranged downstream from the calibrated orifice and designed to delay the opening of the relief valve so as to bring about the momentary opening of the injector needle to perform a pre-injection of fuel.

Depending on the embodiments chosen, the calibrated orifice can be incorporated into the relief valve. Likewise, the valve orifices, flap and electrovalve of the control device can be partially or totally incorporated into the unit bearing the injector.

In one fuel injection device comprising several injectors for the same Diesel engine, the return fuel conduits for each injector can be advantageously connected to one another to a joint return tunnel. This joint return tunnel can be fixed to a calibrated return valve designed to maintain a required level of pressure in said return conduits for each injector.

Likewise, the first discharge circuits can be connected to one another by a joint control tunnel, which can also be fixed to a calibrated control valve designed to maintain a required level of pressure in said discharge circuits for each injector.

In some embodiments, the joint return tunnel and the joint control tunnel can be connected to one another by a calibrated control valve.

BRIEF DESCRIPTION OF THE DRAWINGS

The present invention and its advantages will be more fully disclosed in the following description of various embodiments, shown by way of an unrestricted example, with reference to the attached drawings, in which FIGS. 2 to 7 show an example of embodiment of the device according to the invention, in which FIG. 2 is an axial cutaway view along the II—II axis in FIG. 4, FIG. 3 is an axial cutaway view along the III—III axis in FIG. 4, FIG. 4 is a radial cutaway view along the IV—IV axis in FIG. 3, FIG. 5 is a detailed cutaway view along the V—V axis in FIG. 4, FIG. 6 is a detailed cutaway view of the relief valve, and FIG. 7 is a detailed cutaway view of the calibrated flap, FIGS. 12 to 15 are functional diagrams of various alternative configurations of the device in FIG. 11, FIGS. 16 to 19 show an example of embodiment of the injection device shown schematically in FIG. 14 and simplified by the absence of the piston which acts on the injector needle, in which FIG. 19 is a detailed cutaway view of the relief valve and the delay orifice, FIGS. 20 and 21 partially show a second example of embodiment of the injection device shown schematically in FIG. 14, in which:

DESCRIPTION OF THE PREFERRED EMBODIMENTS

Figure 1:
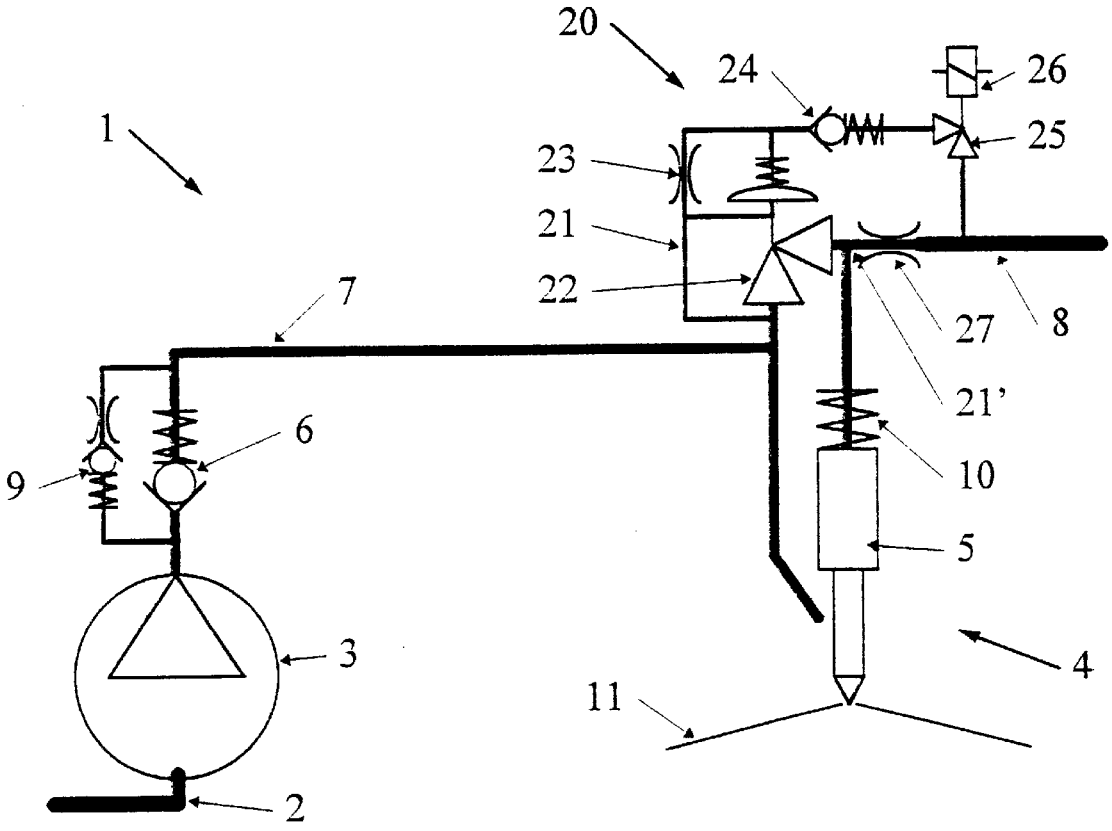
FIG. 1 is a functional diagram of the basic configuration of the injection device according to the invention.
Figure 2:
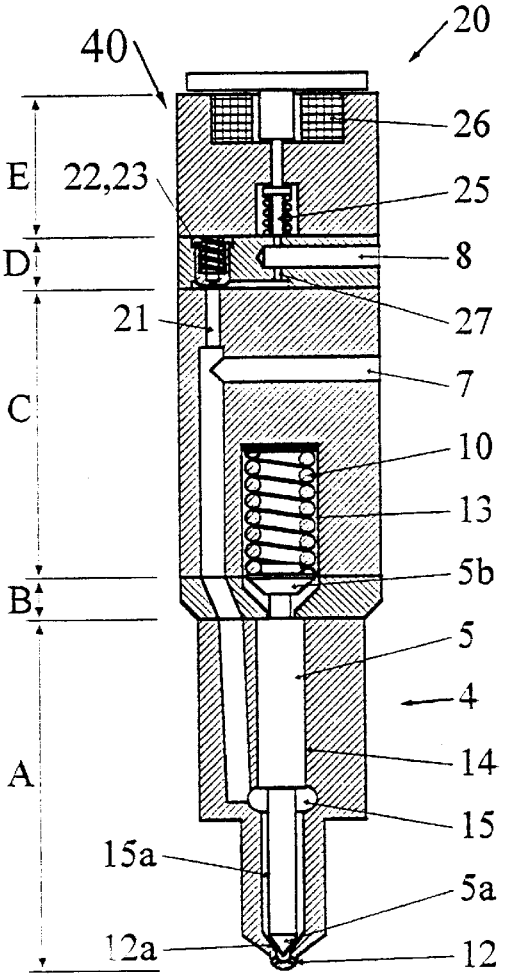
Figure 3:
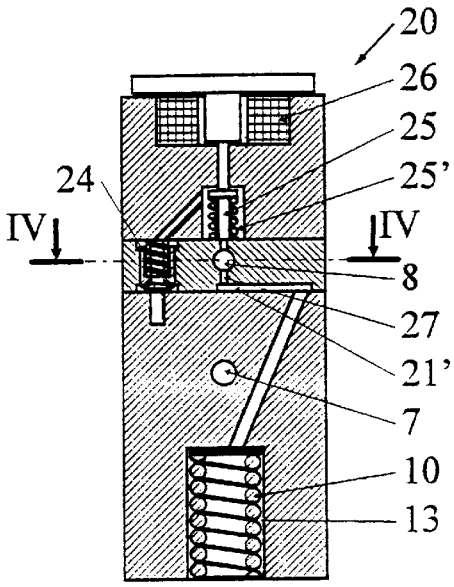
Figure 4:
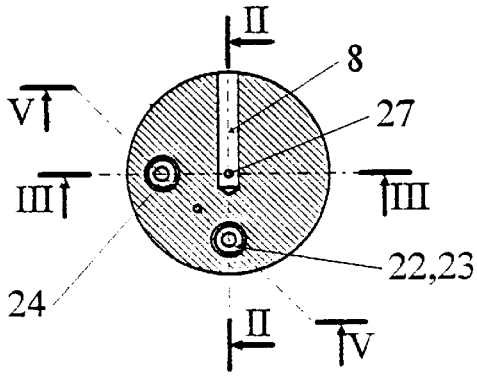
Figure 5:
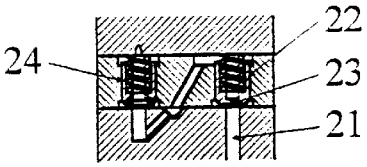
Figure 6:
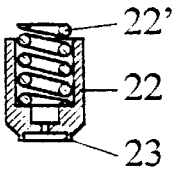

With reference to FIG. 1, the injection device 1 for Diesel engines comprises, in a known manner, a low-pressure conduit 2 which supplies fuel to a pulsating pump 3. This pump 3 feeds an injector 4 provided with an injector needle 5 via a nonreturn valve 6 and a high-pressure conduit 7. The injector 4 is furthermore connected to a low-pressure return conduit 8. A flap 9 for controlling the discharge of the pump 2 can be mounted on a bypass on the nonreturn valve 6. The injector needle 5 is subject to the action of one or several calibration springs 10 and makes it possible to control the high pressure fuel jets 11 which enter the combustion chamber (not shown) of a Diesel engine's piston (not shown). The cavity containing calibration spring(s) 10, not connected to the high pressure, communicates with said low-pressure return conduit 8.

The injection device 1, in accordance with the present invention, comprises, on the injector 4 side, a control device 20 acting directly on the injector needle 5 to improve controlling it both when opening and closing. This control device 20 comprises a first discharge circuit 21 on a bypass between the supply conduits 7 and fuel return conduits 8. It comprises a calibrated orifice 23, a calibrated flap 24 and an electrovalve 25 controlled by a solenoid 26. The control device 20 also comprises a second discharge circuit 21' parallel to the first one, comprising a calibrated relief valve 22 and a calibrated discharge orifice 27 provided on the return conduit 8. This second discharge circuit 21' communicates with the injector needle 5 upstream from the discharge orifice 27. Each injector 4 on the Diesel engine will receive the same control device 20.

With reference to FIGS. 2 to 7, the injection device 1 is shown according to a preferred embodiment of the invention in which the control device 20 is fully incorporated into an injector 40 set containing the injector 4. This injector 4 of standard shape bears the injector needle 5 the tip 5*a* of which closes nozzles 12 for injecting the fuel when the needle is in the low position. This injector needle 5 is controlled in a conventional manner by a calibration spring 10 which exerts pressure on its head 5*b*, the spring and the head being lodged in a cavity 13 coaxial to a guide housing 14 receiving said needle. The injector set is comprised of several parts assembled onto one another to facilitate the integration of the control device 20. In particular, from bottom to top, this injector set 40 comprises:

a part A, which constitutes the injector 4 itself, in which are arranged the guide housing 14 for the injector needle 5, the inlet for the high pressure fuel supply conduit 7 in an annular chamber 15, followed by a tubular chamber 15*a*, both chambers being arranged around the needle, a cone-shaped seat 12*a* receiving the tip 5*a* of the needle, and the injectors 12, a part B, which is used as a stop for the injector needle 5, in which are arranged the base of the cavity 13 receiving the head 5*b* of the needle and the remainder of the high pressure supply conduit 7, a part C, which constitutes the body of the injector carrier, in which are arranged the rest of the cavity 13 receiving the calibration spring 10, the rest of the high pressure supply conduit 7, the start of the discharge circuit 21 and part of the second discharge circuit 21' communicating with said cavity 13, a part D, which constitutes the main block of the control device 20, in which are arranged the remainder of the circuit 21', the return fuel conduit 8, the relief valve 22 and its calibrated orifice 23, the calibrated flap 24 and the discharge orifice 27, a part E, which constitutes the electrovalve set, in which is arranged the electrovalve 25 with its control solenoid 26.

Figure 7:
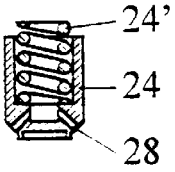

In this embodiment, the calibrated orifice 23, also called regulating nozzle, is fully incorporated into the relief valve 22 (FIG. 6), this valve comprising a calibrated return spring 22'. The calibrated flap 24 comprises a calibrated return spring 24' and radial orifices 28 (FIG. 7). The electrovalve 25 comprises a return spring 25'. The discharge orifice 27, also called regulating nozzle, connects the second discharge circuit 21' to the low pressure return conduit 8 between parts C and D. The first discharge circuit 21 is installed on a bypass with the high pressure supply conduit 7, crosses the calibrated orifice 23, the calibrated flap 24 and the electrovalve 25 towards the low pressure return conduit 8. This first discharge circuit 21 is split into a second parallel discharge circuit 21' crossing the relief valve 22 and the discharge orifice 27 towards the return conduit 8. The cavity 13 of the calibration spring 10 communicates with this second parallel discharge circuit 21', upstream from the discharge orifice 27.

The way the injection device 1 according to the invention operates is described as follows.

When idle, the electrovalve 25 is open. All the other valves or flaps 22, 24 are closed under the effect of the springs 22', 24'. No flow crosses the injection device 1. The residual pressure in this circuit is kept at a required level by the calibrated flap 24.

When the discharge starts and after the filling orifices of the pump 3 close, the latter delivers its flow through the nonreturn valve 6. The pressure increases in the supply conduit 7 as well as in front of the relief valve 22, in its calibrated orifice 23 and in front of the calibrated flap 24. When the flow which crosses the calibrated orifice 23 and the calibrated flap 24 is sufficient, the relief valve 22 opens and allows the flow to pass into the second parallel discharge circuit 21' towards the return conduit 8. Part of this flow is diverted towards the cavity 13 of the calibration spring 10 which is upstream from the discharge orifice 27. This flow creates a pressure in the cavity 13, called the closing pressure, which ensures, by its thrust on the injector needle 5, that the injector 4 is kept in the closed position.

the start of the injection is controlled by the electric signal on the solenoid 26 which closes the electrovalve 25. The flow through the calibrated flap 24 is interrupted. The flow through the calibrated orifice 23 of the relief valve 22 combined with the force provided by the spring 22' progressively closes the relief valve 22. The fuel pressure applied to the injector needle 5 in the chamber 15, called the cutting-in pressure, increases, whilst the closing pressure applied on the calibration spring 10 side decreases, until the injector needle 5 opens. The injection starts as soon as this opening begins. Modulating the start of the injection depends mainly on the closing speed of the relief valve 22.

When the injection is established, the valves or flaps 22, 24, 25 are closed. The whole flow provided by the injection pump 3 is routed towards the injector needle 5 without any restriction and generates nozzle jets 11 with all the pressure the injection device 1 is capable of.

The end of the injection is triggered when the electric signal on the solenoid 26 is interrupted. The electrovalve 25 opens under the effect of its spring 25'. The closing pressure on the relief valve 22 is suddenly reduced. This valve then opens quickly. The pressure in the injection circuit decreases slightly due to the low discharge flow routed towards the discharge orifice 27. At the same time, the rise in pressure at the calibration spring 10 on the injector needle 5 ensures that is closes. When the injector needle 5 closes, the injection is suddenly interrupted, before the drop in pressure in the high pressure supply conduit 7 becomes significant. The flow, still provided by the injection pump 3 crosses the relief valve 22 and the orifices 23 and 27 to be evacuated into the return conduit 8. As the closing and opening pressures on either side of the injector needle 5 are similar, the needle remains closed under the action of its spring 10. The pressure progressively decreases due to the effect of the discharge through the discharge orifice 27 and the return conduit 8.

When the injection pump 3 stops delivering, brought about by the opening of its discharge orifices, the pressure decreases significantly in the whole injection device 1. As soon as the flow crossing the calibrated orifice 23 is sufficiently low, the relief valve 22 closes under the effect of its spring 22'. The closing pressure which makes sure that the injector needle 5 is kept in the closed position, is progressively eliminated. The residual pressure in the whole high pressure circuit is then controlled by the calibrated flap 24 possibly combined with the action of the control flap 9 of the injection pump 3.

Depending on the integration possibilities, the choices of construction and the operating modes for the injection device 1 according to the invention, it is possible to consider various alternatives.

Figure 8:
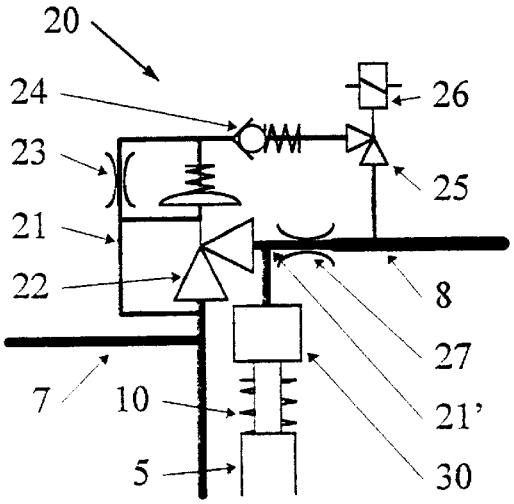
FIG. 8 is a functional diagram of a first alternative configuration of the injection device in FIG. 1.

With reference to FIG. 8, it is possible to add a piston 30 which acts directly on the injector needle 5. In this configuration, the hydraulic pressure generated by the flow released by the relief valve 22 crossing the calibrated discharge orifice 27 acts indirectly on the injector needle 5 by means of a piston 30. The idle volume is consequently more restricted. As a result, the discharge closing the injector 4 requires a smaller drop in pressure at the supply conduit 7. The end of the injection is thereby improved. The section of the piston 30 can be greater than or equal to that of the housing 14 for the needle 5 with a view to increasing the closing thrust.

As was seen in the example shown with reference to FIGS. 2 to 7, it is possible to incorporate all or part of the elements comprising the control device 20 into the injector set 40 containing the injector 4, i.e. the relief valve 22, the calibrated flap 24, the electrovalve 25 and the calibrated orifices 23, 27. It Is also possible to combine the calibrated orifice 23 with the relief valve 22 as shown or to make them separately. What is more, the calibrated flap 24 can be placed upstream, as in FIGS. 1 to 8, or downstream from the electrovalve 25 with reference to FIG. 9. This configuration has the effect of limiting the closed volume between the calibrated orifice 23 and the seat of the electrovalve 25. The operating accuracy of the relief valve 22 is thereby improved and the chance of slowing down the closing of the valve by using a smaller calibrated orifice 23 becomes possible without the risk of ill-timed opening due to pressure pulses.

Figure 9:
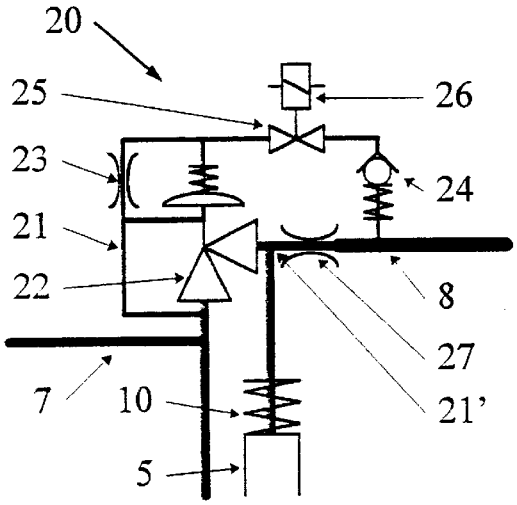
FIG. 9 is a functional diagram of a second alternative configuration of the injection device in FIG. 1.

It has to be noted that the alternative embodiments shown in FIGS. 8 and 9 can be combined.

Furthermore, it is possible to use an injection pump 3 fitted with a device for checking the quantity injected by ramps on the pump piston, which make it possible to either limit the quantity discharged to optimize the energy necessary for pumping purposes, or to control the injection in standby mode. This standby mode is then obtained by leaving the solenoids energized, or by mechanically overriding, with a view to permanently closing the electrovalves.

It is even possible to apply the control device 20 to a shortened injection line, possibly until excess pressure is reached in the high-pressure supply conduit 7, including to an injector-pump.

The above description shows that the invention reaches the aims mentioned. Notably, this injection device makes it possible to:

check the injection advance, the start of the injection depending almost exclusively on the positioning, in the cycle, of the start of the electric signal on the solenoid 26 of the electrovalve 25, dose the quantity injected, which mainly depends on the duration of the electric signal on the solenoid 26 of the electrovalve 25, taking into consideration law of discharge of the injection pump 3, ensure operating safety. Without an electric signal, the control electrovalve 25 remains open and the relief valve 22 allows the whole flow of fuel to pass towards the discharge circuit 21 in the return conduit 8. In the event of the valves 22, 25 remaining blocked in the closed position, the maximum quantity injected is limited to the quantity discharged by the injection pump. This quantity can be adjusted by the pump's standby mode in the event of the injection pump being conventional.

This injection device 1 can be further optimized by:

adjusting the residual pressure obtained by the calibrated flap 24, which avoids cavitation in the injection device 1, controlling the gradient of flow when injection starts, calibrated by the diameter of the calibrated orifice 23 and the force of the spring 22' in the relief valve 22, the cutting-in pressure of the injector needle 5, controlled by the calibration of the spring 10 of said needle. The closing pressure does not depend on the cutting-in pressure, which avoids over-dimensioning the calibration spring 10 of the injector needle 5. Closing is brought about by the pressure generated by the flow routed in the discharge circuits 21, 21' towards the low pressure return conduit 8 through the discharge orifice 27. For this purpose, the sum of the sections of the calibrated orifices 23 and 20 discharge orifices 27 has to be greater than the sum of the sections of the injectors 12 supplying fuel jets 11.

Figure 10:
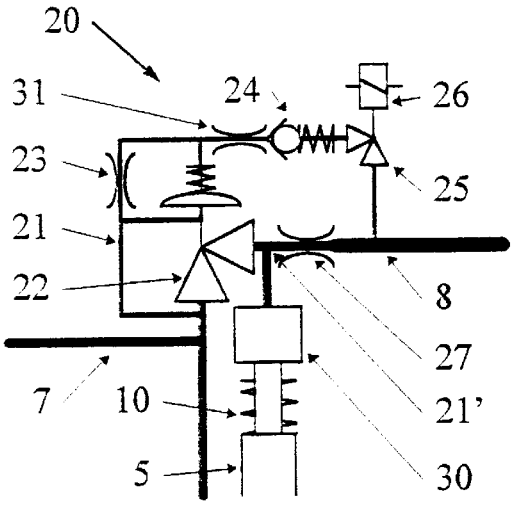
FIG. 10 is a functional diagram of an improvement made to the configuration of the injection device in FIG. 1, making it possible to perform a pre-injection.

It is further possible to perfect this injection device 1, notably by providing for a control device making it possible to perform a pre-injection. In this case, the opening of the relief valve 22 is delayed to allow the injector needle 5 the possibility of starting its opening under the effect of a fuel supply pressure which is greater than its calibration pressure. It is then quickly closed again before the main injection. With reference to FIG. 10, a delay orifice 31 is inserted between the calibrated orifice 23 and the return conduit 8, be it upstream, downstream or incorporated into the calibrated flap 24 or the controlled electrovalve 25. This delay orifice 31 can therefore be added to any configuration of the injection device 1 described previously.

The way the pre-injection sequence operates is described as follows the pressure of the high pressure supply conduit 7 rises under the effect of the injection pump 3, part of the flow discharged escapes through the calibrated orifices 23 and delay orifices 31, the calibrated flap 24 and the controlled electrovalve 25, the pressure necessary for the injector needle 5 to open is reached, which generates the pre-injection, when the pressure continues to increase, the flow crossing the calibrated orifice 23 becomes such that the difference in pressure brings about the opening of the relief valve 22, under the effect of the discharge in the circuit 21', the flow of which is slowed by the discharge orifice 27, the thrust ensuing the closing of the injector needle 5 then interrupts the pre-injection.

Then, the operating sequences are the same as those already described with reference to FIGS. 1 to 7.

By now considering all the injectors equipping the same Diesel engine and allowing for the fact that the calibration of springs remains tricky to repeat identically in each control device 20, one can expect that it is difficult to obtain said injectors operating in a strictly identical manner. With the aim of better controlling the operating balance of these injectors and possibly be able to perform a joint adjustment of said injectors, the following measures can be imagined:

possible excess pressure of the individual calibrated flaps 24, the discharge flows of all the engine's injectors collected in a joint return tunnel, the check and control flows of all the engine's injectors collected in a joint return tunnel, as this tunnel can be mixed up with the previous one, setting the pressure in the joint return tunnel by a return valve with an adjustable or fixed calibration, this setting making it possible to alter the cutting-in pressure of the injectors, setting the pressure in the joint control tunnel by a control valve with an adjustable or fixed calibration, this setting making it possible to alter the opening dynamics of the relief valves 22. In the case of the pre-injection, this setting acts particularly on the dosing of the quantity pre-injected. The setting mode can be either independent or coupled depending on the method of connection.

FIGS. 11 to 15 show five alternative embodiments making it possible to jointly control all the injectors of the same engine.

Figure 11:
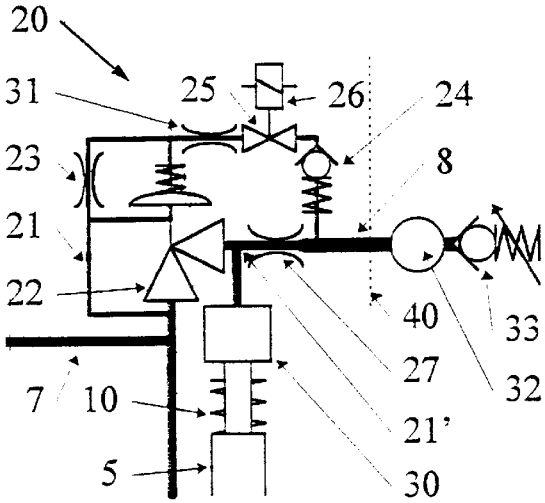
FIG. 11 is a functional diagram of another improvement made to the configuration of the injection device in FIG. 1, making it possible to simultaneously adjust several injection devices on the same engine.

In FIG. 11, the low pressure return conduits 8 are connected to one another to a joint return tunnel 32 comprising a return valve 33 making it possible to pressurize the conduits 8 and as a result to set the cutting-in pressure of the injector needles 5. In this case, the joint external setting of the back pressure applied to the control devices 20 is not provided for.

Figure 12:
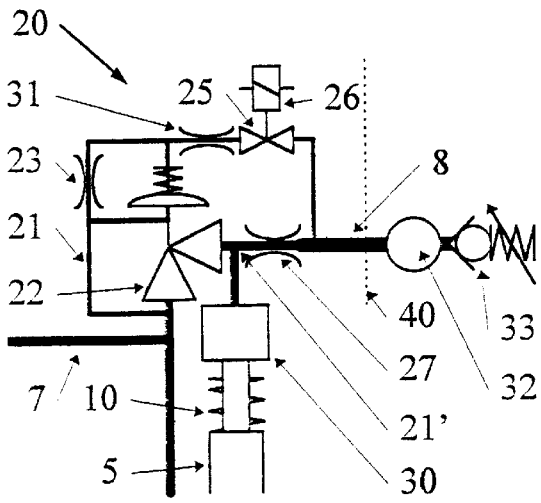

The configuration of FIG. 12 is similar to that in FIG. 11, the only difference being that the calibrated flap 24 has been removed to avoid any difference in the behavior of the individual calibrated flaps 24.

Figure 13:
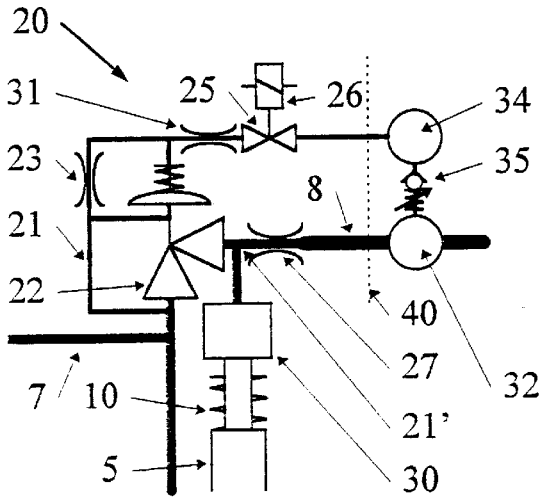

In FIG. 13, the control devices 20 do not have any calibrated flap 24 and are connected to one another, on the outlet side of the controlled electrovalves 25, to a joint control tunnel 34. This joint control tunnel 34 is connected to the joint return tunnel 32 by a control valve 35 making it possible to pressurize the control devices 20 as well as set the dosing of the pre-injection. In this case, the joint external setting of the cutting-in pressure of the injector needles is not provided for.

Figure 14:
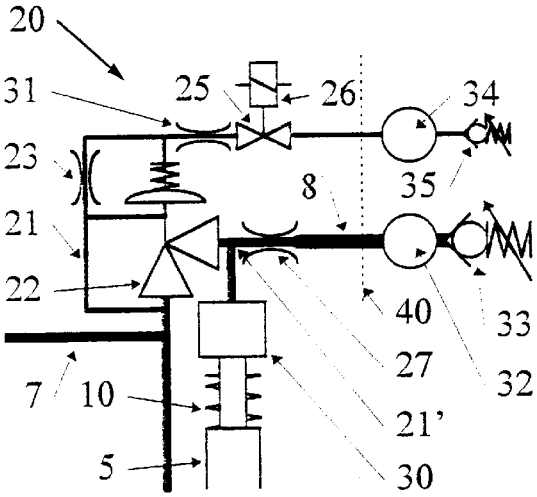

In FIG. 14, the joint control tunnels 34 and return tunnels 32 are separated and each one is connected to its valve 35 and 33. It is therefore possible to both jointly and externally adjust the pressure of the control devices 20, the cutting-in pressure of the injector needles 5 as well as dose the pre-injection.

Figure 15:
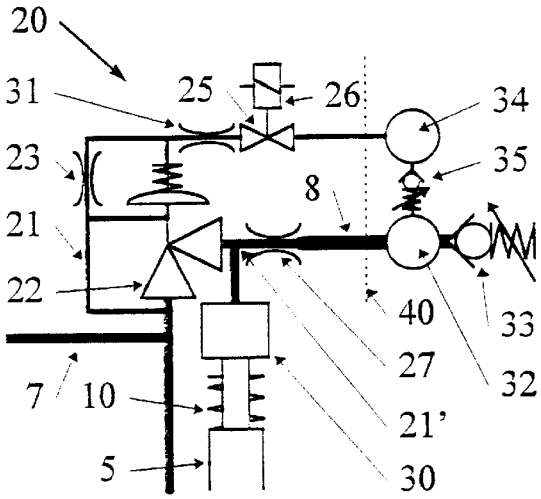

The configuration in FIG. 15 is similar to the one in FIG. 13, the only difference being that the joint return tunnel 32 is completed by its return valve 33. It is therefore possible to both jointly and externally adjust the pressure of the control devices 20 by modulating the difference in pressure between the control tunnels 34 and the return tunnels 32, the cutting-in pressure of the injector needles 5 as well as the dosing of the pre-injection.

Of course, these various configurations of joint return tunnels 32 and control tunnels 34 for all the injectors, pressurized together or separately, can be combined with the alternative embodiments described with reference to FIGS. 1 to 10.

FIGS. 16 to 19 are similar to FIGS. 2, 3, 4 and 6 and show a preferred embodiment of an injection device corresponding substantially to FIG. 14 and simplified by the absence of the piston acting on the injector needle. The control device 20 is fully incorporated into an injector set 40 containing the injector 4 and comprised of parts A to E. The differences lie in the fact that the return and control circuits are separate. Part C receives the return conduit 8 which communicates directly with the cavity 13 of the calibration spring 10 of the injector needle 5 by the discharge orifice 27. This return conduit 8 is designed to be connected to the joint and external return tunnel 32. In part D, the conduit 36 is designed to be connected to the joint and external control tunnel 34. Part E is completed by the delay orifice 31 and a conduit 37 which allows this delay orifice 31 to communicate with the controlled electrovalve 25.

In this embodiment, the calibrated orifice 23 is also incorporated into the relief valve 22 (FIG. 19) and the delay orifice 31 is arranged coaxial to this relief valve 22 and to its calibrated orifice 23. The calibrated flap 24 has been removed.

The way the injection device operates, with reference to FIGS. 16 to 19, is described as follows.

When idle, the electrovalve 25 is open and the relief valve 22 is closed under the effect of its spring 22'. No flow crosses through the injector set 40. The residual pressure in this circuit is kept at a level required by the joint control tunnel 34 and its control valve 35 not shown.

When the discharge starts and after the filling orifices of the pump 3 close, the latter delivers its flow by means of a nonreturn valve 6. The pressure rises in the supply conduit 7 as well as in front of the relief valve 22 and in its calibrated orifice 23. However the flow is slowed by the delay orifice 31 which brings about an increase in pressure in the chamber 15 located around the injector needle 5 in a sufficient manner to cause it to open and thereby perform a pre-injection.

When the flow which crosses the calibrated orifice 23 and the delay orifice 31 is sufficient, the relief valve 22 opens and allows the flow to pass into the parallel discharge circuit 21' towards the cavity 13 of the calibration spring 10. This relief brings about a drop in pressure in the chamber 15 of the injector needle 5 and an increase in the pressure in the cavity 13 which pushes on the injector needle 5 to close it and interrupt the pre-injection. The pressurization of the cavity 13 is ensured by the discharge orifice 27 and by the joint and external return tunnel 32 combined with its return valve 33, not shown.

the start of the injection is controlled by the electric signal on the solenoid 26 which closes the electrovalve 25. The reduction in the flow through the calibrated orifice 23 and the relief valve 22 combined with the stress provided by the spring 22' progressively closes the relief valve 22. The fuel pressure applied to the injector needle 5 in the chamber 15 increases, whilst the closing pressure applied on the calibration spring 10 end decreases, until the injector needle 5 opens. The injection starts as soon as this opening begins.

When the injection is established, the relief valve 22 and the controlled electrovalve 25 are closed. The whole flow provided by the injection pump 3 is routed towards the injector needle 5 without any restrictions and generates nozzle jets 11 with all the pressure the injection device 1 is capable of.

The end of the injection is triggered when the electric signal on the solenoid 26 is interrupted. The electrovalve 25 opens under the effect of its spring 25'. The closing pressure on the relief valve 22 is suddenly reduced. This valve then opens quickly. The pressure in the injection circuit decreases slightly due to the low discharge flow routed towards the joint control tunnel 34. At the same time, the increase in pressure on the calibration spring 10 side on the injector needle 5 ensures it closes. As the injector needle 5 closes, the injection is suddenly interrupted, before the fall in pressure in the high pressure supply conduit 7 becomes significant. The flow, still being provided by the injection pump 3, crosses through the relief valve 22 and is evacuated in the return tunnel 32 and control tunnel 34. The closing and opening pressures, on either side of the injector needle 5 being in the vicinity of one another, the needle remains closed under the action of its spring 10. The pressure decreases progressively due to the effect of the discharge through said tunnels 32, 34.

When the injection pump 3 stops discharging, caused by the opening of its discharge orifices, the pressure falls sharply in the whole injection device 1. As soon as the flow crossing the calibrated orifice 23 is sufficiently low, the relief valve 22 closes under the effect of its spring 22'. The closing pressure ensuring that the injector needle 5 is kept in the closed position, is progressively eliminated. The residual pressure in the whole high pressure circuit is then controlled by the control valve 35 (not shown) provided on the joint control tunnel 34, possibly combined with the action of the control flap 9 of the injection pump 3.

Figure 16:
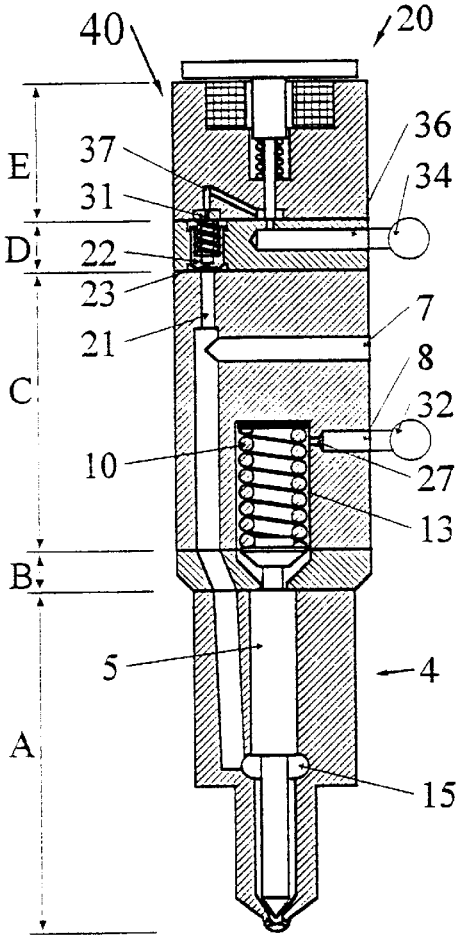
FIG. 16 is an axial cutaway view along the XVI—XVI axis in FIG. 18.
Figure 17:
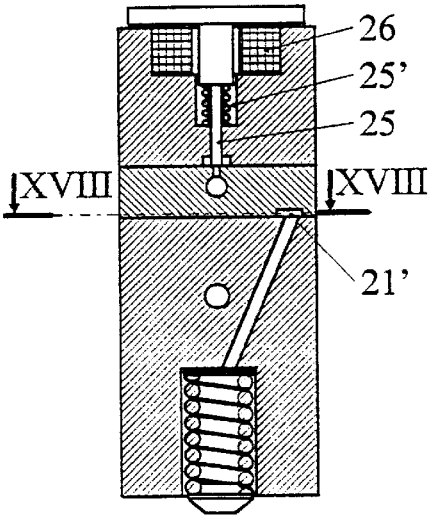
FIG. 17 is an axial cutaway view along the XVII—XVII axis in FIG. 18.
Figure 19:
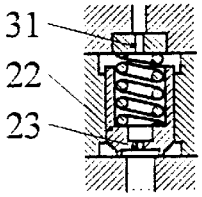
Figure 18:
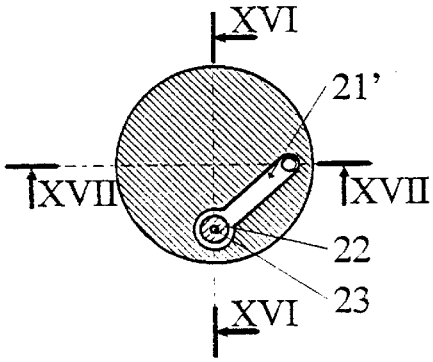
FIG. 18 is a radial cutaway view along the XVIII—XVIII axis in FIG. 17.
Figure 20:
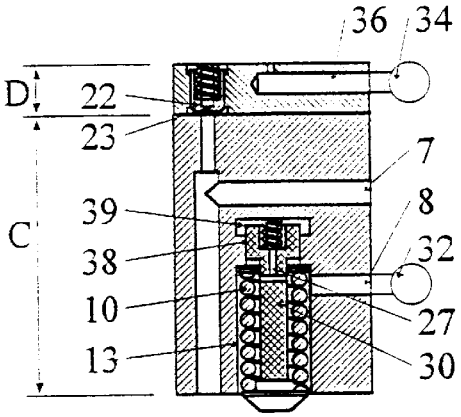
FIG. 20 is an axial cutaway view similar to FIG. 16.
Figure 21:
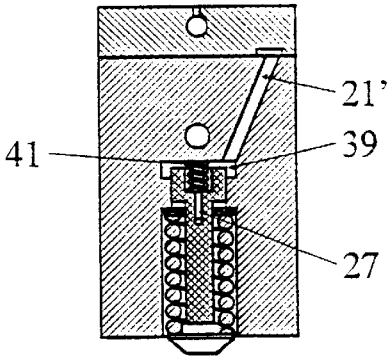
FIG. 21 is an axial cutaway view similar to FIG. 17.

FIGS. 20 and 21 are similar views to FIGS. 16 and 17. They show only parts C and D of the injector set 40 to show an alternative embodiment in which the injector needle 5 is closed by the action of a piston 30. This piston 30 is lodged and guided in a cavity 38 arranged coaxial and just above the cavity 13. This cavity 38 is topped by a compression chamber 39 receiving the upper part of the piston 30 and communicating with the parallel discharge circuit 21'. This piston 30 is kept resting against the injector needle 5 by a spring 41. It also comprises an inside conduit replacing the discharge orifice 27 which allows the compression chamber 39 to communicate with the return conduit 8. In this embodiment, the operating mode is similar to that in the previous embodiment. The only difference lies in the fact that adding the piston 30 makes it possible to considerably reduce the volume to be compressed to close the injector needle 5.

A remark has to be made about the orifices 23, 27, 31 provided in the various alternative embodiments described above. These orifices can be the "capilllary" type for which the head loss is proportional to the flow or the "jet" type for which the head loss increases in proportion to the square of the flow. It is then possible to combine these various types to obtain:

four possible configurations in the case of a control device comprising the orifices 23 and 27, eight possible configurations in the case of a control device allowing the pre-injection and comprising the orifices 23, 37 and 31.

Depending on the combination used, it is then possible to act on a variety of the injection device's behaviors:

by modulating the opening speed of the injector needle combined with choosing the volume to be compressed to push it, by changing some characteristics like for example the dosing of the pre-injection according to the engine's speed of rotation or possibly the quantity injected.

In the event of capillaries being used, they can be made for example by machining a groove which is either helicoidal on the cylindrical part of the valve's guide device, the is flap, the piston or a slug pressed on, or spiral on a flat surface in contact with another surface.

Now, the injection diagrams corresponding to the various embodiments of the injector device 1 are described with reference to FIGS. 22 to 25.

In each diagram, four curves a to d are shown which correspond from top to bottom to the lift of the injector needle 5 (curve a), to the flow of fuel injected by the nozzles 12 in the combustion chamber of a Diesel engine's piston (curve b), to the pressure provided by the injection pump 3 (curve c) and to the pressure in the conduit 7 at the entry to the injector 4 (curve d). These curves are shown in relation to time for a fraction of the cycle.

Figure 22:
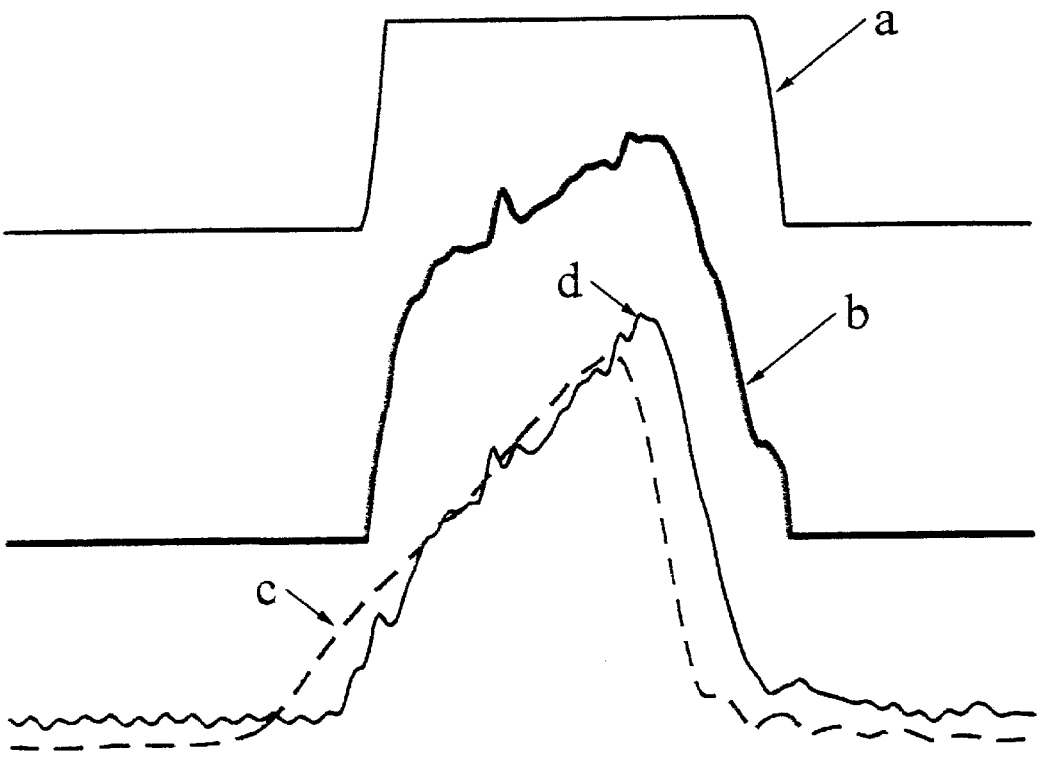
FIGS. 22 to 25 show injection diagrams corresponding to various configurations of the injection device, in which FIG. 22 corresponds to a conventional injection device, FIG. 23 corresponds to the injection device in FIG. 1, FIG. 24 corresponds to the injection device in FIG. 8, FIG. 25 corresponds to the injection device in FIG. 10.

FIG. 22 shows the injection diagram of a standard and known injection device corresponding to the prior art of the invention. It can be clearly seen that the end of the injection is not very efficient, which is harmful to the engine's performance and to emissions of fumes.

Figure 23:
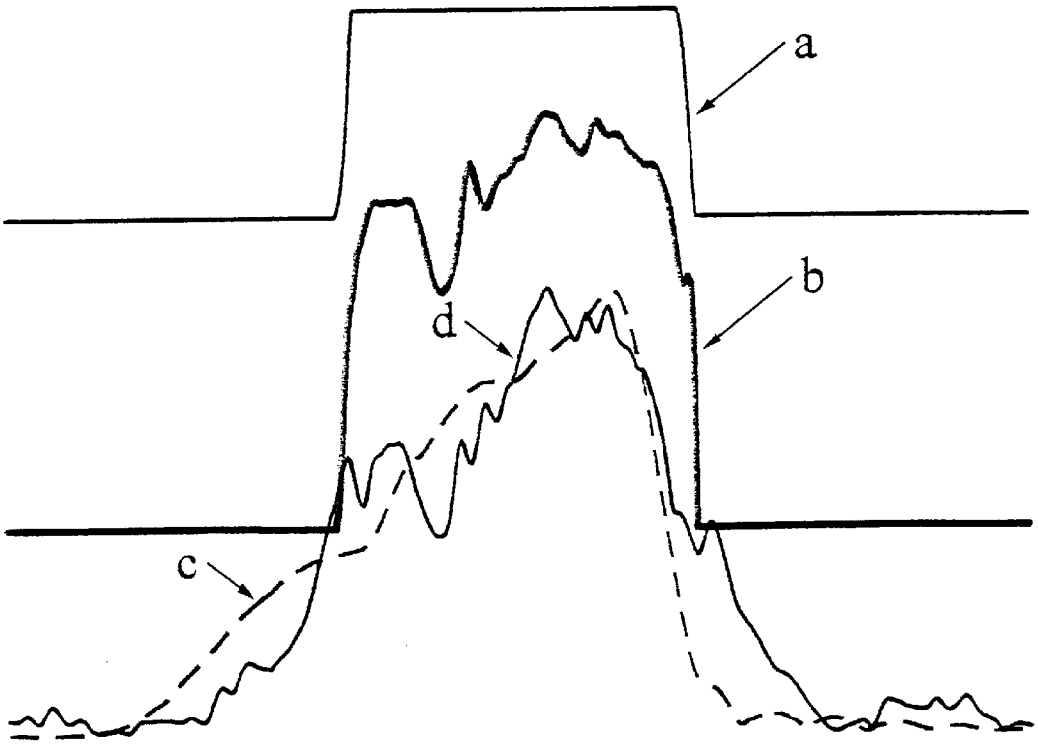

FIG. 23 shows the injection diagram of the injection device in FIG. 1, in which the command for closing the injector needle 5 is given by the control device 20. It can be seen that the end of the injection is considerably improved. On the other hand, the start of the injection remains sudden, which can generate combustion noises.

Figure 24:
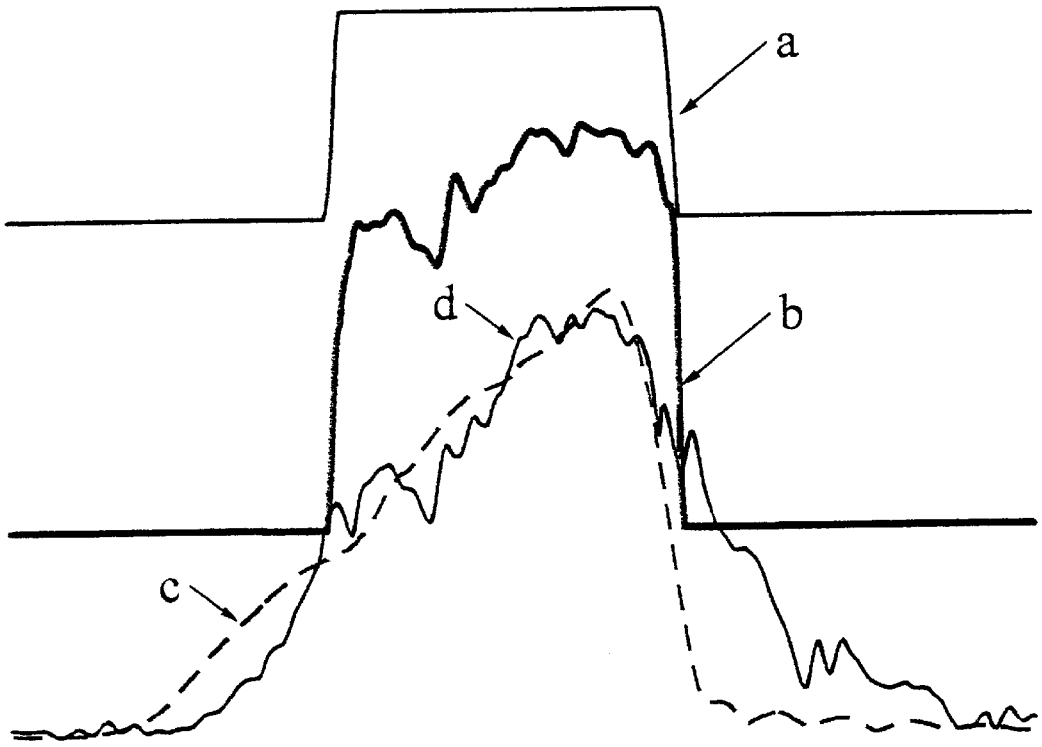

FIG. 24 shows the injection diagram of the injection device in FIG. 8, in which the injector needle 5 is controlled by the piston 30. It can be seen that the end of injection is improved further. This solution is therefore very satisfactory for the engine's performance. Nevertheless, combustion noises still remain.

Figure 25:
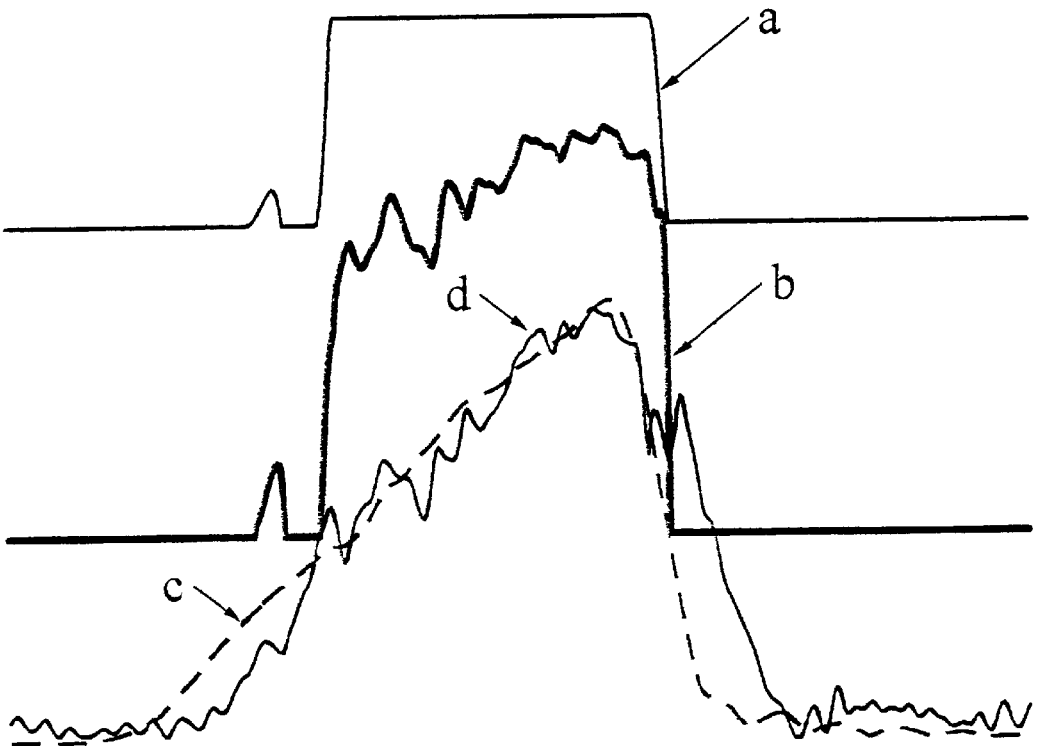

FIG. 25 shows the injection diagram of the injection device in FIG. 10, in which the delay orifice 31 is provided, which makes it possible to perform a pre-injection before the main injection. When the injection starts, this solution provides the correction required to reduce the combustion noise. It consequently benefits from all the advantages. It is of course clear that the pre-injection cycle can be added to that of the main injection depending on how the commands are synchronized.

The present invention is not restricted to the forms of embodiment described, but can undergo various alterations and be presented in various aspects derived from the forms described in an obvious manner for an expert.

What is claimed is:

1. A fuel injection device (1) for diesel engines equipped with a pulsating injection pump (3), the device comprising, for each piston, at least one injector (4) receiving a calibrated injector needle (5) designed to inject calibrated pressurized fuel jets (11) into the a chamber of said piston, a high pressure fuel supply conduit (7) and a low pressure fuel return conduit (8), wherein the fuel injection device (1) comprises a control device (20) for opening and closing said needle (5), the device comprising a first discharge circuit (21) connecting the supply conduit (7) and the return conduit (8) for the fuel, provided with a calibrated orifice (23) and controlled by an electrovalve (25) and a second discharge circuit (21') parallel to the first one and comprising a calibrated relief valve (22) and a discharge orifice (27) arranged on the return conduit (8), this second discharge circuit (21') communicating with the injector needle (5) upstream from the discharge orifice (27), said relief valve (22) being designed to make sure that both the start of the injection is progressive and that this injection closes quickly by diverting the flow of fuel which is not injected towards said discharge orifice (27) which, when depressurizing the supply conduit (7), generates a closing pressure on the injector needle (5).

2. The device according to claim 1, wherein the first discharge circuit (21) comprises a calibrated flap (24) arranged upstream or downstream from the electrovalve (25), this flap being designed to keep the injection device (1) at a required pressure level between two injections.

3. The device according to claim 1, wherein the control device (20) is separated from the high pressure fuel injection circuit (7) during the injection cycle, the relief valve (22) and the electrovalve (25) being closed.

4. The device according to claim 1, wherein the closing pressure is applied directly on the injector needle (5).

5. The device according to claim 1, wherein the closing pressure is applied on the injector needle (5) by means of a piston (30).

6. The device according to claim 1, wherein the control device (20) comprises a delay orifice (31) arranged downstream from the calibrated orifice (23) and designed to delay the opening of the relief valve (22) so as to cause the momentary opening of the injector needle (5) to perform a pre-injection of fuel.

7. The device according to claim 1, wherein the calibrated orifice (23) is incorporated in the relief valve (22).

8. The device according to claim 1, wherein the orifices, valve, flap and electrovalve (22–25, 27, 31) of the control device (20) are partially or totally incorporated into the unit bearing the injector (4).

9. A fuel injection device (1) comprising several injectors for the same Diesel engine, according to any of the previous claims, characterized in that the return fuel conduits (8) of each injector (4) are connected to one another to a joint return tunnel (32).

10. The device according to claim 9, wherein the joint return tunnel (32) is fixed to a calibrated return valve (33) designed to maintain a required level of pressure in said return conduits (8) of each injector.

11. The device according to claim 9, wherein the first discharge circuits (21) are connected to one another by a joint control tunnel (34).

12. The device according to claim 11, wherein the joint control tunnel (34) is fixed to a calibrated control valve (35) designed to maintain a required level of pressure in said discharge circuits (21) of each injector.

13. The device according to claim 11, wherein the joint return tunnel (32) and the joint control tunnel (34) are connected to one another by a calibrated control valve (35).

* * * * *